US007992498B2

(12) United States Patent
Ruhlman et al.

(10) Patent No.: US 7,992,498 B2
(45) Date of Patent: Aug. 9, 2011

(54) REDUCED COLLATERAL DAMAGE BOMB (RCDB) AND SYSTEM AND METHOD OF MAKING SAME

(76) Inventors: James D. Ruhlman, Santa Rosa Beach, FL (US); Blake K. Thomas, Ashton, MD (US)

( * ) Notice: Subject to any disclaimer, the term of this patent is extended or adjusted under 35 U.S.C. 154(b) by 639 days.

(21) Appl. No.: 11/844,804

(22) Filed: Aug. 24, 2007

(65) Prior Publication Data

US 2011/0146521 A1 Jun. 23, 2011

Related U.S. Application Data

(60) Provisional application No. 60/840,232, filed on Aug. 25, 2006.

(51) Int. Cl.
*F42B 12/20* (2006.01)
*F42B 12/72* (2006.01)

(52) U.S. Cl. ..... 102/473; 102/479; 102/382

(58) Field of Classification Search ..... 102/382, 102/473, 478, 479, 481, 516, 517, 519, 491, 102/489, 499, 396
See application file for complete search history.

(56) References Cited

U.S. PATENT DOCUMENTS

| | | | | |
|---|---|---|---|---|
| 3,693,548 | A | 9/1972 | Dereich et al. | |
| 4,152,987 | A * | 5/1979 | Lundstrom et al. | 102/382 |
| 4,448,129 | A | 5/1984 | Gabriels | |
| 4,615,272 | A * | 10/1986 | Aubert | 102/466 |
| 4,860,659 | A * | 8/1989 | Andreetta | 102/473 |
| 5,054,399 | A * | 10/1991 | Bilek et al. | 102/481 |
| 5,515,785 | A * | 5/1996 | Zglenicki | 102/473 |
| 5,852,256 | A * | 12/1998 | Hornig | 102/473 |
| 5,939,662 | A * | 8/1999 | Bootes et al. | 102/473 |
| 7,472,653 | B1 * | 1/2009 | Hays et al. | 102/481 |
| 7,845,282 | B2 * | 12/2010 | Sheridan et al. | 102/473 |
| 2002/0069784 | A1 | 6/2002 | Landman et al. | |
| 2007/0051267 | A1 * | 3/2007 | Meddes et al. | 102/307 |
| 2010/0263566 | A1 * | 10/2010 | Ruhlman et al. | 102/499 |

OTHER PUBLICATIONS

International Search Report and Written Opinion, International Patent Application No. PCT/US07/76757, Sep. 22, 2008, 8 pages.

* cited by examiner

*Primary Examiner* — James S Bergin
(74) *Attorney, Agent, or Firm* — Wilmer Cutler Pickering Hale and Dorr LLP

(57) ABSTRACT

A reduced collateral damage bomb (RCDB) bomb casing is described and disclosed along with the system and method for making it. The RCDB bomb casing may be formed from conventional or penetrating warhead bomb casings. The RCDB bomb casing has a filler material/materials disposed on the interior walls that will assist in controlling the collateral damage caused by the finished bomb but not prevent the appropriate destructive power being delivered to a selected target.

13 Claims, 8 Drawing Sheets

REDUCED COLLATERAL DAMAGE BOMB (RCDB) AND SYSTEM AND METHOD OF MAKING SAME

CROSS REFERENCE TO RELATED APPLICATIONS

This application claims the priority under 35 U.S.C. §119 (e) of U.S. Provisional Application No. 60/840,232, filed Aug. 25, 2006.

TECHNICAL FIELD

The present invention relates generally to bombs that are used to deliver high explosives to selected targets. More specifically, the present invention relates to bombs that deliver high explosive to selected targets but have the capability to reduce unwanted collateral damage.

BACKGROUND OF THE INVENTION

Bombs can have bomb casing of a conventional or penetrating warhead (PW) type. "Conventional" as it is used herein in describing a bomb casing means the shape and characteristics of the bomb casing as would be understood in the bomb industry.

Typically, bomb casings are filled with high explosive material and an end cap is used to seal the open end. Finished bombs using these bomb casings may be in 250, 500, 1000, and 2000 lb. classes or larger. The selection of the particular class of bomb will depended on the amount of high explosive that needs to be delivered to a selected target. Such bombs have been in the U.S. weapons inventory for a number of years.

Conventional and PW bomb casings each have a prescribed wall thickness. For any given bomb pound class, the interior cavity of the bomb casing will be tightly filled with high explosive material so that the finished bomb of a particular class will deliver predictable destructive power to a selected target. If the destructive power were not predictable, there is a strong likelihood either the appropriate destructive power will not be delivered to a target or excessive power will be delivered, but in each case there will be a waste of resources.

As is reported many times in the media when bombs are used, there is a problem with the amount of collateral damage near where such bombs are delivered to selected targets. The collateral damage may be to structures in the immediate area or to the civilian population. Therefore, it would be optimal for bombs to deliver high explosives to the selected target and not inflict undesired collateral damage unless that was the intention.

It is understood in the bomb industry that just reducing the size of the bomb, for example, from a 1000 to 500 lb. class bomb to reduce collateral damage may mean that collateral damage is reduced but there are other problems. The typical problem is that the smaller bomb may be inadequate to destroy the selected target because the mass of the 1000-pound class bomb may still be needed for target destruction.

There is desire for bombs of any class to have a reduced collateral damage capability yet not reduce the effectiveness of the bomb to deliver predictable destructive power for the destruction of the selected target.

SUMMARY OF THE INVENTION

The present invention is a reduced collateral damage bomb (RCDB) bomb casing and the system and method for making such casings. The RCDB bomb casings of the present invention are constructed with a filler material applied to the interior walls of the bomb casing. This filler material is applied in a controlled manner to reduce the volume of the cavity within the bomb casing. The remaining interior cavity of the bomb casing is filled with high explosive material after the filler material is applied to the interior walls.

The filler material is typically a material that is inert to the high explosive material even if the bombs are stored for a period of time. The filler material also may have properties that assist in providing destructive power to the bomb, but still reduce the collateral damage of the bomb.

An object of the present invention is to provide a conventional or PW bomb casing that will reduce the collateral damage of the finished bomb when it is delivered to a selected target.

Another object of the present invention is to provide a conventional or PW bomb casing that has a filler material coated on the interior walls that assists in reducing the collateral damage of the finished bomb when it is delivered to a selected target.

A further object of the present invention is to provide a conventional or PW bomb casing that has a filler material coated on the interior walls that has properties to enhance the destructive power of the bomb but with a reduced collateral damage effect.

These and other objects will be described in greater detail in the remainder of the specification referring to the drawings.

DESCRIPTION OF THE PRESENT INVENTION

The present invention is directed to a reduced collateral damage bomb (RCDB) bomb casing and the system and method of making such bomb casings. As will be shown, the RCDB bomb casings have a filler material disposed on the interior walls of the interior cavity that will assist in controlling the collateral damage caused by the bomb but not prevent the appropriate destructive power from being delivered to a selected target.

Figure 1:
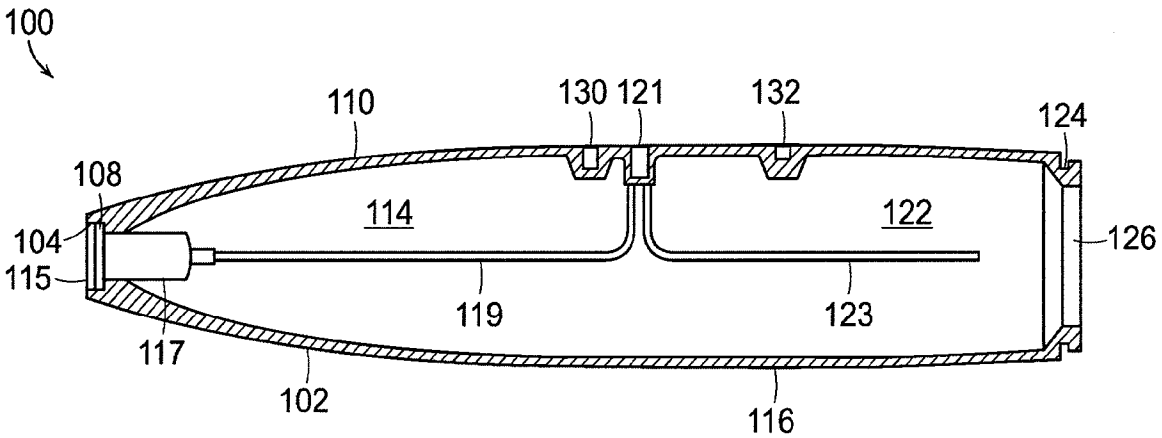
FIG. 1 Prior Art
FIG. 1 shows a cross-sectional view of a conventional bomb casing (without the aft fuze liner or closure components) that does not incorporate the present invention.

FIG. 1, generally at 100, shows a cross-sectional view of a conventional bomb casing, for example, for Mark 80 series bomb bodies. The bomb casing includes ogive-shaped, front section 102 and cylindrical-shaped, rear section 116. The bomb casing, preferably, is made of a low carbon steel 10XX, 41XX low alloy or for a specific application can be made of a high strength alloy steel, such as a 43XX alloy or higher strength material.

Ogive-shaped, front section 102 and cylindrical-shaped, rear section 116 may be formed separately or as a single unit and still be within the scope of the present invention.

The wall thickness of ogive-shaped, front section 102 progressively increases from rear edge 110 of this section to front end 104. Threaded bore 108 is disposed in front end 104 and extends through the front end wall thickness to central opening 114 in ogive-shaped, front section 102. Threaded bore 108 receives threaded bomb nose plug (not shown) in a screw-nut relationship. Nose fuze liner 117 is shown that will receive the proximal end of the nose plug.

Preferably, cylindrical-shaped, rear section 116 has a substantially uniform wall thickness, except at rear end 124. The wall thickness of the cylindrical-shaped, rear section is substantially the same as the wall thickness of ogive-shaped, front section 102 at rear edge 110. The cylindrical-shaped, rear section has central opening 122. The combination of central opening 114 in ogive-shaped, front section 102 and central opening 122 in cylindrical-shaped, rear section 116 form the interior cavity of bomb casing 102.

Cylindrical-shaped, rear section 116 has threaded bores 130 and 132. Each of the threaded bores receives the threaded base of a suspension lug (not shown). The suspension lugs are used for lifting the finished bombs and attaching them to aircraft bomb racks.

Cylindrical-shaped, rear section 116 also has charging receptacle 121. Charging tube 119 connects between charging receptacle 121 and nose fuze liner 117. Charging tube 123 connects between charging receptacle 121 and a tail fuze liner (not shown).

End 124 of cylindrical-shaped, rear section 116 has opening 126 that receives an aft-end fuze liner and closure structure (not shown). The aft-end closure structure holds the tail fuze liner. A fin assembly (not shown) attaches to the aft-end closure structure 124. In the finished bomb, the interior cavity of the bomb casing is filled with high explosive material.

Figure 2:
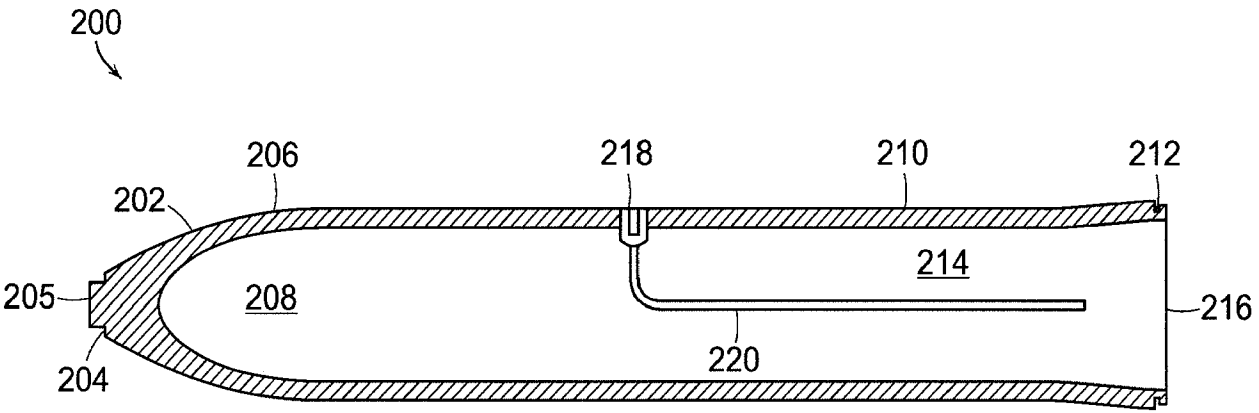
FIG. 2 Prior Art
FIG. 2 shows a cross-sectional view of a conventional penetrating warhead bomb casing (without the aft fuze liner or closure components) that does not incorporate the present invention.

FIG. 2, generally at 200, shows a penetrating warhead ("PW") bomb casing that is currently available in a variety of sizes from 250 lbs. to over 5000 lbs. The casing can have an ogive-shaped, front section 202 and cylindrical-shaped, rear section 210. The bomb casing, preferably, is made of a high strength alloy steel, such as a 43XX or higher strength material The nose shape shown is ogive-shaped, front section 202 and cylindrical-shaped, rear section 210 may be formed separately or as a single unit and still be within the scope of the present invention.

The nose shape shown is ogive-shaped, front section 202 has a wall thickness that progressively increases from rear edge 206 of this section to forward end 204. The ogive-shaped, front section has central opening 208. Front end 204 of ogive-shaped, front section 202 has threaded nose portion 205 extending from it. Threaded nose portion 205 is for receiving a retaining ring of a guidance kit (not shown) in a threaded relationship.

Preferably, cylindrical-shaped, rear section 210 has a substantially uniform wall thickness, except at rear end 212. The wall thickness of the cylindrical-shaped, rear section is substantially the same as the wall thickness of ogive-shaped, front section 202 at rear edge 206. The cylindrical-shaped, rear section has central opening 214. The combination of central opening 208 and central opening 214 form the interior cavity of bomb casing 202.

Cylindrical-shaped, rear section 210 has charging receptacle 218. Charging tube 220 connects between charging receptacle 218 and a tail fuze liner (not shown). This charge tube is eliminated on some PW. End 212 of cylindrical-shaped, rear section 210 has opening 216 that receives the fuze liner and aft-end closure structure (not shown). The aft-end closure structure holds the tail fuze liner. A fin assembly (not shown) attaches to aft-end closure structure 212. In the finished bomb, the interior cavity of the bomb casing is filled with high explosive material.

Although not shown in FIG. 2, cylindrical-shaped, rear section 210 may have an assembly attached to it for receiving the threaded bases of two or more suspension lugs (not shown). The suspension lugs, as stated, are used for lifting the finished bombs and attaching them to aircraft wing bomb mounts.

Figure 3:
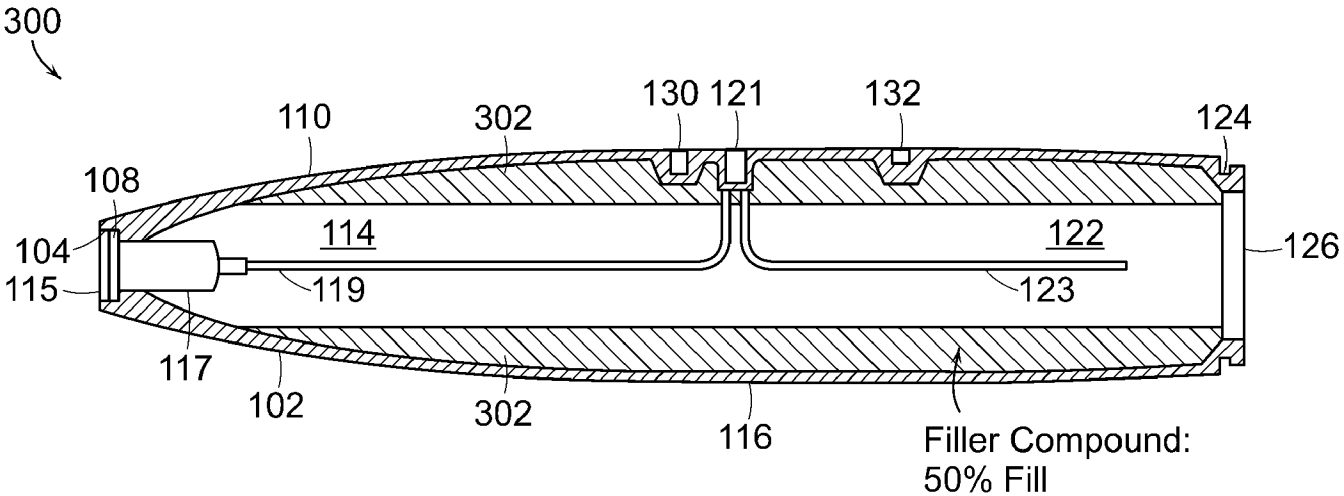
FIGS. 3 and 4 show cross-sectional views of an embodiment of a conventional bomb casing (without the aft fuze liner or closure components) that has different thickness of filler material coating the interior walls of the internal cavity according to the present invention.
Figure 4:
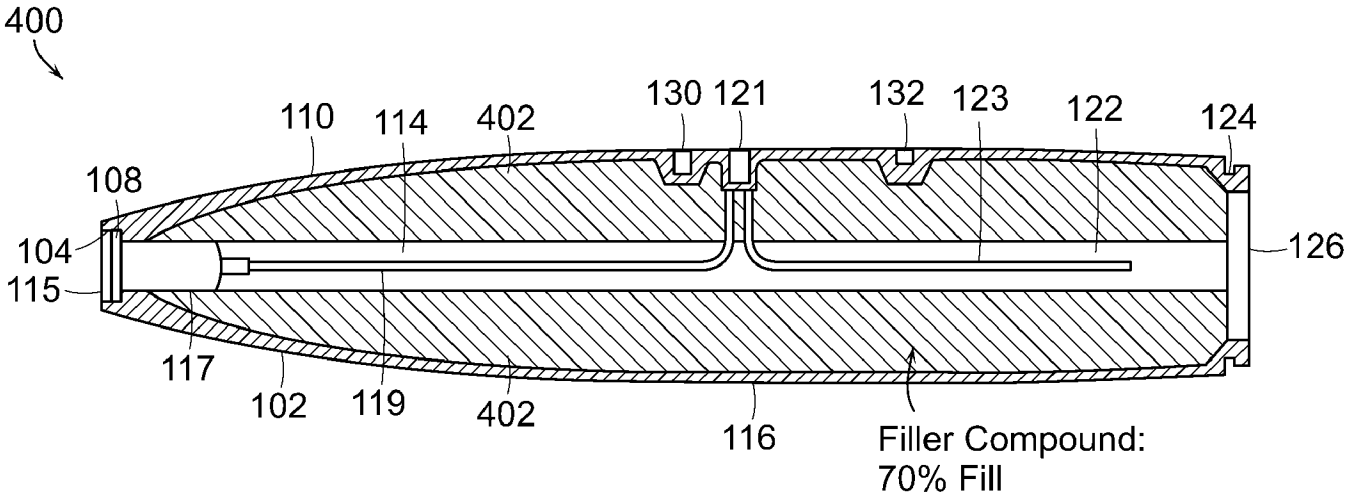

An embodiment of a RCDB conventional bomb casing according to the present invention is shown at FIGS. 3 and 4. With respect to FIGS. 3 and 4, the conventional bomb casing that is shown is the conventional bomb casing of FIG. 1 and, therefore, the conventional bomb casing has the same reference numbers. The differences in the reference numbers between what is shown in FIG. 1, and FIGS. 3 and 4 are what has been added according the present invention to make the conventional bomb casing a RCDB conventional bomb casing.

Referring to FIG. 3, a RCDB conventional bomb casing is shown generally at 300. The RCDB conventional bomb casing has ogive-shaped, front section 102 and cylindrical-shaped, rear section 116. Ogive-shaped, front section 102 has a wall thickness that progressively increases from rear edge 110 to forward end 104. Threaded bore 108 is disposed in front end 104 and extends through the front end wall thickness to central opening 114 in ogive-shaped, front section 102.

Cylindrical-shaped, rear section 116 has a substantially uniform wall thickness, except at rear end 124. The wall thickness of the cylindrical-shaped, rear section is substantially the same as the wall thickness of ogive-shaped, front section 102 at rear edge 110. The cylindrical-shaped, rear section has central opening 122. Cylindrical-shaped, rear section 116 has threaded bores 130 and 132 for the threaded bases of suspension lugs. Cylindrical-shaped, rear section 116 also has charging receptacle 121. Charging tube 119 connects between charging receptacle 121 and nose fuze liner 117. Charging tube 123 connects between charging receptacle 121 and a tail fuze liner (not shown). End 124 of cylindrical-shaped, rear section 116 has opening 126 that receives an aft-end closure structure. The aft-end closure structure holds the tail fuze liner.

According to the present invention, filler material 302 is spin coated on the interior walls of the interior cavity formed by central openings 114 and 122. The filler material will reduce the volume of the interior cavity, thereby reducing the side explosive impact of the finished bomb.

The filler material is an inert compound that will not react with the explosive material and reduce its explosive potential. The filler material although inert also may have properties that will enhance the explosive capability of the bomb when compared to a bomb that has an explosively neutral filler material. Whether the filler material is explosively neutral or will enhance the explosive capability, the finished bomb that includes filler material will reduce collateral damage.

Again referring to FIG. 3 at 300, the conventional bomb casing that includes ogive-shaped, front section 102 and cylindrical-shaped, rear section 116 has a spin coating of filler material applied to the interior walls to a thickness that reduces the interior cavity volume by 50%. Preferably, the spin coating of filler material is distributed in a manner to form an interior cylindrical channel along the longitudinal axis of the bomb casing. The cylindrical channel has a substantially uniform diameter. The cylindrical channel will be filled with high explosive material. The filler material will help focus the destructive power of the bomb through the front of the finished bomb while reducing the channeling of the destructive power out from the sides of the bomb.

Referring to FIG. 4, a RCDB conventional bomb casing is shown generally at 400. The RCDB conventional bomb casing that is shown in FIG. 4 differs from the RCDB conventional bomb casing in FIG. 3 in that filler material 402 is spin coated on the interior walls to a thickness that reduces the interior cavity volume of the bomb casing by 70% rather than 50%. The other features of the filler material as described for the RCDB conventional bomb casing shown in FIG. 3 apply equally to FIG. 4 and are incorporated here by reference.

Figure 5:
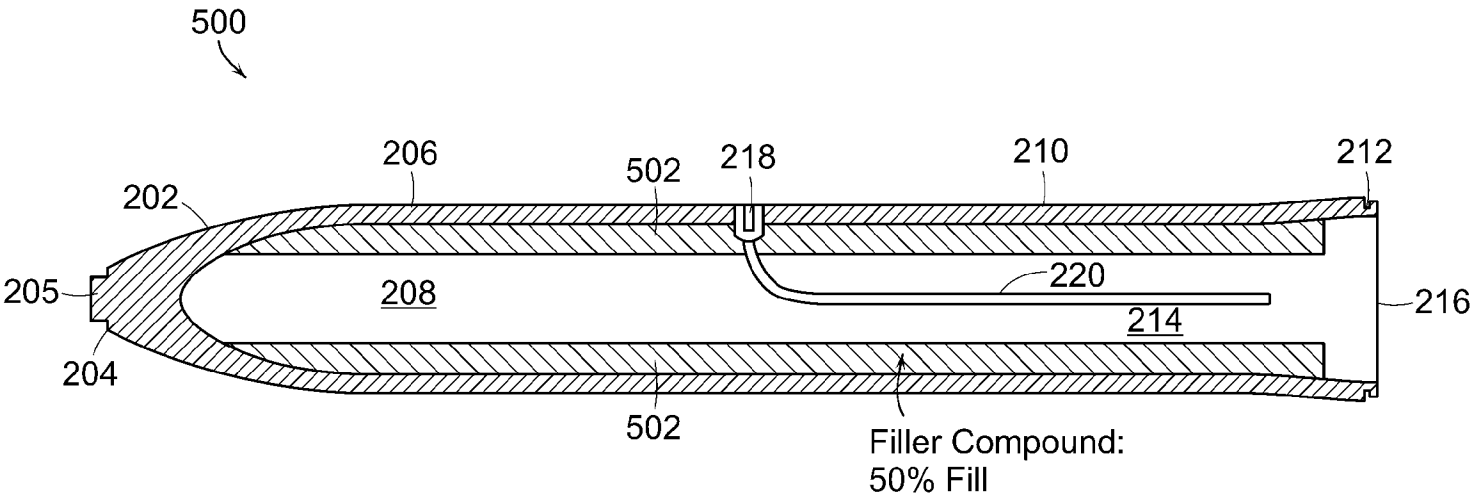
FIGS. 5 and 6 show cross-sectional views of an embodiment of a PW bomb casing (without the aft fuze liner or closure components) that has different thickness of filler material coating the interior walls of the interior cavity according to the present invention.
Figure 6:
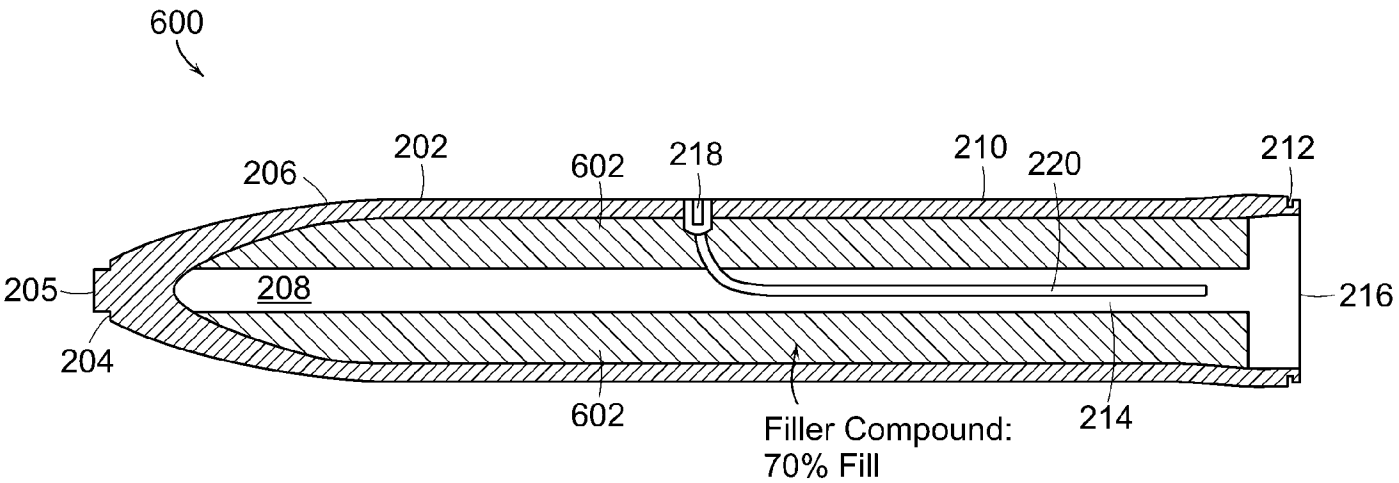

An embodiment of a RCDB PW bomb casing according to the present invention is shown at FIGS. 5 and 6. With respect to FIGS. 5 and 6, the PW bomb casing that is shown is the PW bomb casing of FIG. 2 and, therefore, the PW bomb casing has the same reference numbers. The differences in the reference numbers between what is shown in FIG. 2, and FIGS. 5 and 6 are what has been added according to the present invention to make the PW bomb casing a RCDB PW bomb casing.

Referring to FIG. 5, a RCDB PW bomb casing is shown generally at 500. The RCDB PW bomb casing has ogive-shaped, front section 202 and cylindrical-shaped, rear section 210. Ogive-shaped, front section 202 has a wall thickness that progressively increases from rear edge 206 of this section to forward end 204. The ogive-shaped, front section has central opening 208. Front end 204 of ogive-shaped, front section 202 has threaded nose portion 205 extending from it.

Cylindrical-shaped, rear section 210 has a substantially uniform wall thickness, except at rear end 212. The wall thickness of the cylindrical-shape, rear section is substantially the same as the wall thickness of the ogive-shaped, front section at rear edge 206. The cylindrical-shaped, rear section has central opening 214. Cylindrical-shaped, rear section 210 has charging receptacle 218 to which charging tube 220 connects. End 212 of cylindrical-shaped, rear section 210 has opening 216 that receives an aft-end closure structure (not shown). The aft-end closure structure holds the tail fuze liner.

According to the present invention, filler material 502 is spin coated on the interior walls of the interior cavity formed by central openings 208 and 214. The filler material will reduce the volume of the interior cavity that receives the high explosive material.

As stated with respect to FIGS. 3 and 4, filler material 502 preferably is an inert compound that will not react with the explosive material and reduce its explosive potential. Filler material 502 although inert also may have properties that will enhance the explosive capability of the bomb when compared to a bomb that has an explosively neutral filler material. Whether the filler material is explosively neutral or will enhance the explosive capability, the bomb will have reduced collateral damage.

Again referring to FIG. 5 at 500, the PW bomb casing that includes ogive-shaped, front section 202 and cylindrical-shaped, rear section 210 has a spin coating of filler material applied to the interior walls to a thickness that reduces the interior cavity volume by 50%. Preferably, the spin coating of filler material is distributed in a manner to form an interior cylindrical channel along the longitudinal axis of the bomb casing. The cylindrical channel has a substantially uniform diameter. The cylindrical channel will be filled with high explosive material. The filler material will help focus the destructive power of the bomb through the aft-end of the bomb while reducing the channeling of the destructive power out from the sides of the bomb. This application could be applied when the kinetic energy required to penetrate a structure requires the weight but the internal void only required a low volume of high explosive to neutralize the target.

Referring to FIG. 6, a RCDB PW bomb casing is shown generally at 600. The RCDB PW bomb casing that is shown in FIG. 6 differs from the RCDB PW bomb casing in FIG. 5 in that filler material 602 is spin coated on the interior walls to a thickness that reduces the interior cavity volume of the bomb casing by 70% rather than 50%. The other features of the filler material as previously described for the RCDB PW bomb casing shown in FIG. 5 apply equally to FIG. 6 and are incorporated here by reference.

Referring to FIGS. 3, 4, 5, and 6, the filler material shown at 302, 402, 502, and 602, respectively, that is spin coated on the interior walls of the interior cavity has weight properties substantially similar to those of the explosive material it replaces. This is so the finished bomb will have substantially the same weight, center of gravity, moment of inertia, and aerodynamic properties as a bomb filled only with high explosive material.

When the filler material, such as that shown at 302, 402, 502, and 602 is added within the bomb casings, the resulting RCDB will provide a predictable level of reduced collateral damage destructive power. As such, bombs formed according to the present invention that include filler material may have a thickness of the filler material that will change according to the amount of high explosive material needed to be delivered to a selected target to destroy it but minimize undesired collateral damage near the target.

The filler material preferably will fill 25%-75% of the interior cavity volume of the bomb casing when it is spin-coated on the interior walls. The filler material will have properties that will permit it to adhere to the walls and itself when spin-coated on and cured. Preferably, the filler material will be explosively neutral or be a composite material that will provide special destructive characteristics to enhance the bomb's destructive capabilities. For example, the filler materials may include a combination of heavier and lighter materials that per unit volume is equivalent to the high explosive material it replaces. Examples of explosively inert, i.e., explosively neutral, filler material are polymer materials that use binders that will not interact with (or is inert to) the high explosive material. Further, examples of inert explosive enhancing filler materials are ones in which the polymer material with binders also has beads added to it that contain elements, such as oxygen, that can be desirable when such beads are used in an enclosed environment or such materials as tungsten or aluminum are added to create special desired effects.

FIG. 7, generally at 700, and FIG. 8, generally at 800, will be used to describe the method of the present invention for forming the RCDB bomb casings of the present invention. The method of the present invention is substantially the same for both types of bomb casings, conventional and PW. Accordingly, in describing the method, the reference number for the conventional bomb casing in FIG. 7 will be given first then the corresponding reference number for the PW bomb casing in FIG. 8 will be given.

Open-ended bomb casing 702/802 is obtained that is desired to transform into a RCDB bomb casing. Charge tube stabilizer 704/804 is used to support and stabilize the charge tube 124/212 of bomb casing 702/802. Charge tube stabilizer 704/804 includes seal 705/805 that is inserted into the aft-end to control the level of the inert filler material that is added into the bomb casing. Charge tube stabilizer 704/804 has adapter tube 710/810 extending though it that has a length within the interior cavity of bomb casing 702/802 to extend over the end of charge tube 123/220, as shown at 706/806. This will prevent filler material from fouling the charge tube during the spin coating process. Further, adapter tube 710/810 also extends outward from seal 705/805 a length, and the distal end of the adapter tube connects to a spin stabilizer wheel 714/814. The adapter and spin stabilizer wheel will stabilize the charge tube 123/220 during the filler material spin coating process.

After level controlling seal 705/805 and adapter tube 710/810 with spin stabilizer wheel 714/814 are in place, bomb casing 702/802, preferably, is placed in a variable speed horizontal centrifugal casting machine. The machine will have counterbalancing capabilities to provide an offset for the inserts, which are known in the industry, e.g., a gyro-based system, and inert filler material while the machine is coming up to the speed required to spin coat the inert filler material on the bomb casing walls. It is understood that other machines may be used that are capable of spinning the bomb casing and still be within the scope of the present invention.

The next step of the process is to insert a spout from a hopper containing the filler material with the binder and other desired materials being mixed thereto into the bomb casing through the open spoke spin stabilizer wheel at the aft-end of the item. The amount of filler material that is poured into the interior cavity of bomb casing 702/802 is calculated to provide a desired thickness on the interior walls of the bomb casing and form the previously discussed cylindrical channel. This amount will allow the finished bomb to provide the desired destructive power to the selected target and reduce the collateral damage.

Bomb casing 702/802 that is filled with the desired amount of filler material is spun at a predetermined speed for a predetermined period of time to spin coat the interior walls of the interior cavity with filler material. The spin coating will form a cylindrical channel within the bomb casings as shown, for example, in FIGS. 3 and 5. While bomb casing 702/802 is being spun, the exterior of the bomb casing can be heated to cure the filler material as it spin coats the interior walls of the bomb casing.

Following spin coating and curing the filler material to the interior walls of bomb casing 702/802, the bomb casing is removed from the casting machine. Next, seal 705/805 is removed, which also results in adapter tube 710/810, along with spin stabilizer wheel 714/814, being removed from the end of charge tube 123/220. Bomb casing 102/202 may now be made ready for normal processing into a finished bomb.

The terms and expressions which are used herein are used as terms of expression and not of limitation. And, there is no intention, in the use of such terms and expressions, of excluding the equivalents of the features shown and described, or portions thereof, it being recognized that various modifications are possible in the scope of the invention.

The invention claimed is:

1. A reduced collateral damage bomb casing, comprising:

(A) a tapering cylindrical shaped front section of the bomb casing that includes a closed front end and an open aft-end, and front section having a first interior opening, with the front section further having a progressively decreasing wall thickness from the front end to the open aft-end;

(B) a substantially uniform cylindrical shaped rear section of the bomb casing that includes a front edge that interfaces with the aft-end of the front section, an open aft-end, and the rear section having a second interior opening, with the rear section further having a substantially uniform wall thickness from the front edge to the open aft-end, with the front and rear sections forming an integrated, single unit bomb casing and the first and second interior openings combining to form an interior cavity for the bomb casing; and (C) filler material disposed on interior walls of the interior cavity is of a thickness to reduce a volume of the interior cavity by a predetermined amount to reduce the collateral damage of a bomb by a predetermined amount, and provide an interior channel having substantially a length of the bomb casing once the filler material is disposed on the interior walls.

2. The bomb casing as recited in claim 1, wherein the tapering cylindrical shaped front section includes ogive-shaped front section.

3. The bomb casing as recited in claim 1, wherein the wall thickness of the front section at the aft-end is substantially the same as the wall thickness of the rear section at the front-end where the front and rear sections interface.

4. The bomb casing as recited in claim 1, wherein the bomb casing includes a conventional bomb casing.

5. The bomb casing as recited in claim 1, wherein the bomb casing includes a penetrating warhead bomb casing.

6. The bomb casing as recited in claim 1, wherein the interior channel includes a cylindrical channel.

7. The bomb casing as recited in claim 6, wherein the interior channel has a substantially uniform diameter along its length.

8. The bomb casing as recited in claim 1, wherein the filler material includes explosively neutral filler material.

9. The bomb casing as recited in claim 8, wherein the filler material includes filler material from a class of polymers with a binder material that are inert to high explosive material and any additions thereto.

10. The bomb casing as recited in claim 8, wherein the filler material includes a polymer with a binder material that is inert to a high explosive material and any additions thereto.

11. The bomb casing as recited in claim 1, wherein the filler material includes filler material that has explosive enhancing properties.

12. The bomb casing as recited in claim 11, wherein the filler material includes filler material from a class of polymers with a binder material that are inert to high explosive material and any additions thereto.

13. The bomb casing as recited in claim 11, wherein the filler material includes a polymer with a binder material that is inert to a high explosive material and any additions thereto.

* * * * *

UNITED STATES PATENT AND TRADEMARK OFFICE

CERTIFICATE OF CORRECTION

PATENT NO. : 7,992,498 B2
APPLICATION NO. : 11/844804
DATED : August 9, 2011
INVENTOR(S) : James D. Ruhlman et al.

Figure 7A:
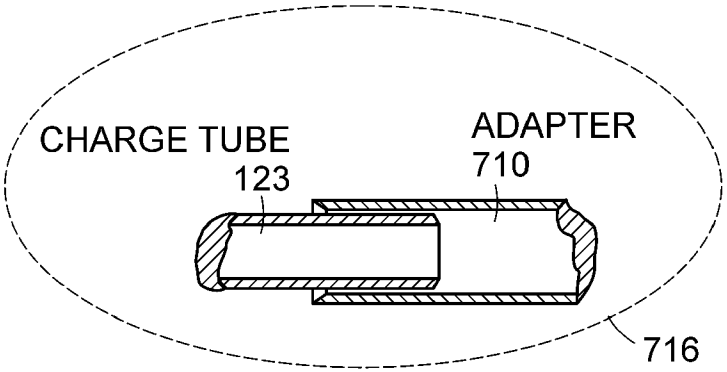
FIG. 7 shows a conventional bomb casing for describing the method of spin coating a filler material on interior walls of the interior cavity according to the present invention.
Figure 7B:
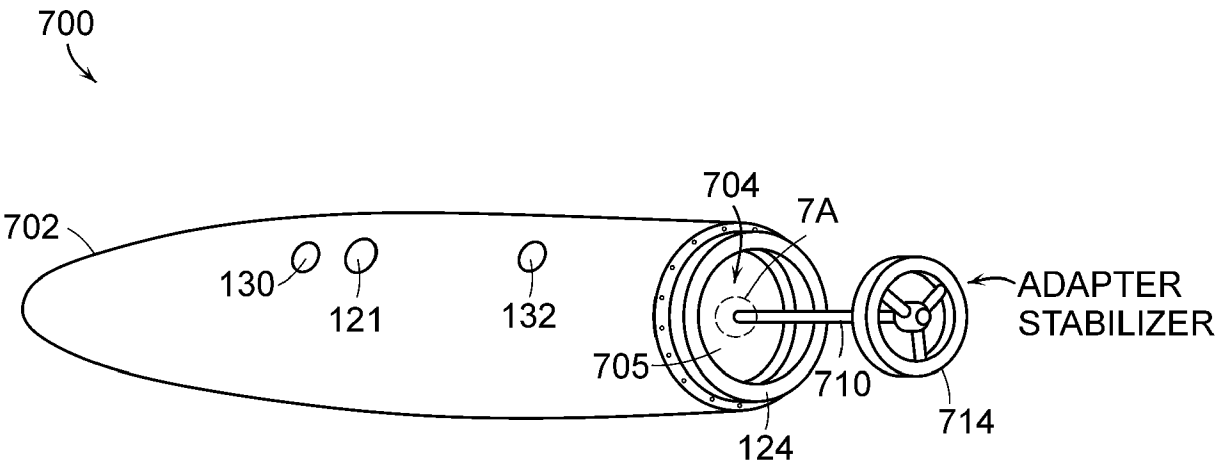

It is certified that error appears in the above-identified patent and that said Letters Patent is hereby corrected as shown below:

Column 2, line number 49, replace "Fig. 7" with --Fig. 7A and 7B--

Figure 8A:
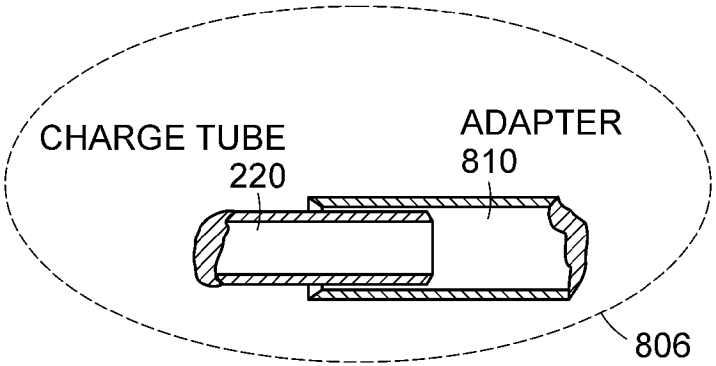
FIG. 8 shows a PW bomb casing for describing the method of spin coating a filler material on interior walls of the interior cavity according to the present invention.
Figure 8B:
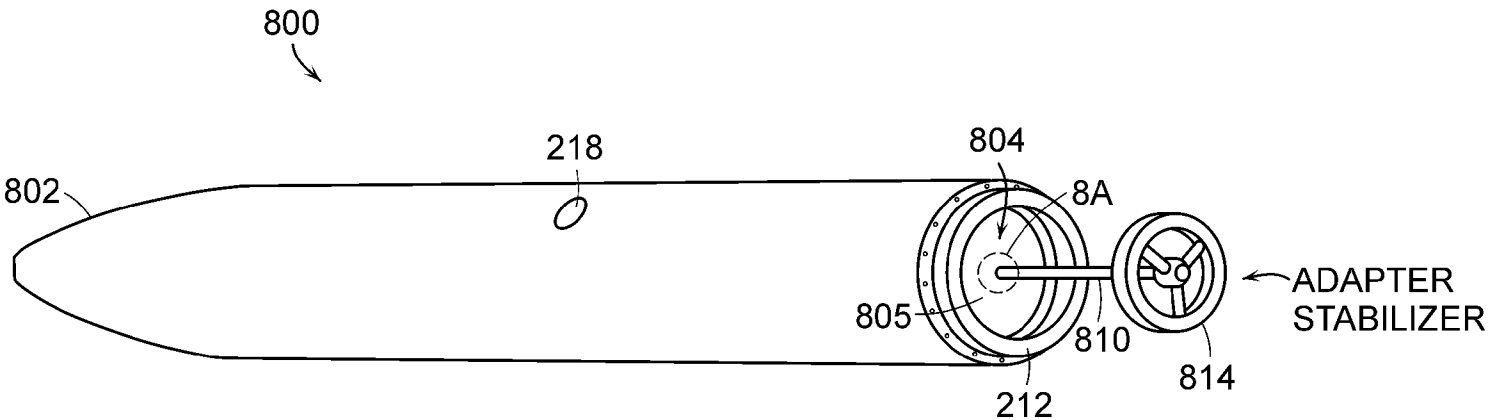

Column 2, line number 52, replace "Fig. 8" with --Fig. 8A and 8B--

Column 6, line number 59, replace "Fig. 7" with --Fig. 7A and 7B--

Column 6, line number 59, replace "Fig. 8" with --Fig. 8A and 8B--

Column 6, line number 65, replace "Fig. 7" with --Fig. 7A and 7B--

Column 6, line number 67, replace "Fig. 8" with --Fig. 8A and 8B--

Signed and Sealed this
Fourth Day of October, 2011

David J. Kappos

David J. Kappos
*Director of the United States Patent and Trademark Office*